US009625229B1

(12) United States Patent
Hilz

(10) Patent No.: US 9,625,229 B1
(45) Date of Patent: Apr. 18, 2017

(54) WINDOW MOUNTED GUN REST

(71) Applicant: Ryan Hilz, Brookshire, TX (US)

(72) Inventor: Ryan Hilz, Brookshire, TX (US)

( * ) Notice: Subject to any disclaimer, the term of this patent is extended or adjusted under 35 U.S.C. 154(b) by 0 days.

(21) Appl. No.: 15/151,975

(22) Filed: May 11, 2016

(51) Int. Cl.
*F41A 23/02* (2006.01)
*F16M 13/02* (2006.01)

(52) U.S. Cl.
CPC ..... *F41A 23/02* (2013.01); *F16M 13/022* (2013.01)

(58) Field of Classification Search
CPC ..... F41A 23/02
USPC ..... 42/94
See application file for complete search history.

(56) References Cited

U.S. PATENT DOCUMENTS 4,558,532 A 12/1985 Wright
5,778,589 A 7/1998 Teague
5,964,435 A 10/1999 Peltier

*Primary Examiner* — Reginald Tillman, Jr.
(74) *Attorney, Agent, or Firm* — Stevenson IP, LLC

(57) ABSTRACT

A window mounted gun rest including an inverted U-shaped mounting clamp. A threaded aperture is disposed through a rear portion of the mounting clamp, and a plate screw is threadably engaged within the threaded aperture. A mounting plate is disposed between each of a front portion and the rear portion of the mounting clamp. The mounting plate is attached to a tip of the plate screw. A muzzle rest is disposed on a middle portion of the mounting clamp. An elevation support arm is hingedly attached to the rear portion of the mounting clamp. A padded support member is disposed on the elevation support arm. An elevation locking mechanism is configured to selectively lock the elevation support arm into one of a plurality of heights relative to the muzzle rest.

3 Claims, 4 Drawing Sheets

WINDOW MOUNTED GUN REST

BACKGROUND OF THE INVENTION

Various types of gun rests are known in the prior art. However, what has been needed is a window mounted gun rest including an inverted U-shaped mounting clamp, a threaded aperture disposed through a rear portion of the mounting clamp, and a plate screw threadably engaged within the threaded aperture. What has been further needed is a mounting plate disposed between each of a front portion and the rear portion of the mounting clamp, with the mounting plate attached to a tip of the plate screw. Lastly, what has been needed is a muzzle rest disposed on a middle portion of the mounting clamp, an elevation support arm hingedly attached to the rear portion of the mounting clamp, a padded support member disposed on the elevation support arm, and an elevation locking mechanism configured to selectively lock the elevation support arm into one of a plurality of heights relative to the muzzle rest. The window mounted gun rest thus provides a user with a more stable and accurate shooting platform from inside a hunting blind.

FIELD OF THE INVENTION

The present invention relates to gun rests, and more particularly, to a window mounted gun rest.

SUMMARY OF THE INVENTION

The general purpose of the present window mounted gun rest, described subsequently in greater detail, is to provide a window mounted gun rest which has many novel features that result in a window mounted gun rest which is not anticipated, rendered obvious, suggested, or even implied by prior art, either alone or in combination thereof.

To accomplish this, the present window mounted gun rest includes a single inverted U-shaped mounting clamp having a front portion, a rear portion, and a middle portion disposed between the front portion and the rear portion. Each of the front portion, the rear portion, and the middle portion has an external surface and an internal surface, and each of the front portion and the rear portion has a right surface, a left surface, a top surface, and a bottom surface. A threaded aperture is disposed through the rear portion of the mounting clamp at approximately one-third of a height of the rear portion from the bottom surface, with the threaded aperture medially disposed between the right surface and the left surface. A plate screw is threadably engaged within the threaded aperture. The plate screw has a head disposed outside of the mounting clamp and a tip disposed between each of the front portion and the rear portion of the mounting clamp. A mounting plate is disposed between each of the front portion and the rear portion of the mounting clamp. The mounting plate is attached to the tip of the plate screw.

The window mounted gun rest further includes an upright substantially rectangular muzzle rest medially disposed on the external surface of the middle portion of the mounting clamp. The muzzle rest has an upper edge and a U-shaped indentation medially disposed on the upper edge. An elongated rectangular elevation support arm is hingedly attached to the external surface of the rear portion of the mounting clamp at approximately one-third of the height of the rear portion from the top surface. The elevation support arm has a front edge, a back edge, an upper surface, and a lower surface. A rectangular padded support member is disposed on the upper surface of the elevation support arm from proximal the back edge to approximately two-thirds of a length of the elevation support arm.

An elevation locking mechanism further includes a pair of quadrant-shaped adjustment plates and a spring-loaded locking pin. The pair of adjustment plates is disposed on the upper surface of the elevation support arm adjacent to the front edge. Each of the pair of adjustment plates has a plurality of circular openings. The spring-loaded locking pin is removably and simultaneously disposable through one of the plurality of openings of a first of the pair of adjustment plates and one of the plurality of openings of a second of the pair of adjustment plates. The elevation locking mechanism is configured to selectively lock the elevation support arm into one of a plurality of heights relative to the muzzle rest depending on a preference of a user.

The mounting clamp is removably disposable around a top area of a window sill of a deer blind. The plate screw is configured to selectively secure the mounting plate to the top area of the window sill of the deer blind. Each of the front portion, the rear portion, and the middle portion of the mounting clamp is optionally rectangular in order to better support the mounting plate on the top area of the window sill of the deer blind. Additionally, a width of the elevation support arm is equal to a width of the rear portion of the mounting clamp. It is envisioned that a spring-loaded swivel can also be included on the muzzle rest to provide the user with the ability to rotate the gun from side to side with ease while the gun continues to remain stable on the muzzle rest.

Thus has been broadly outlined the more important features of the present window mounted gun rest so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
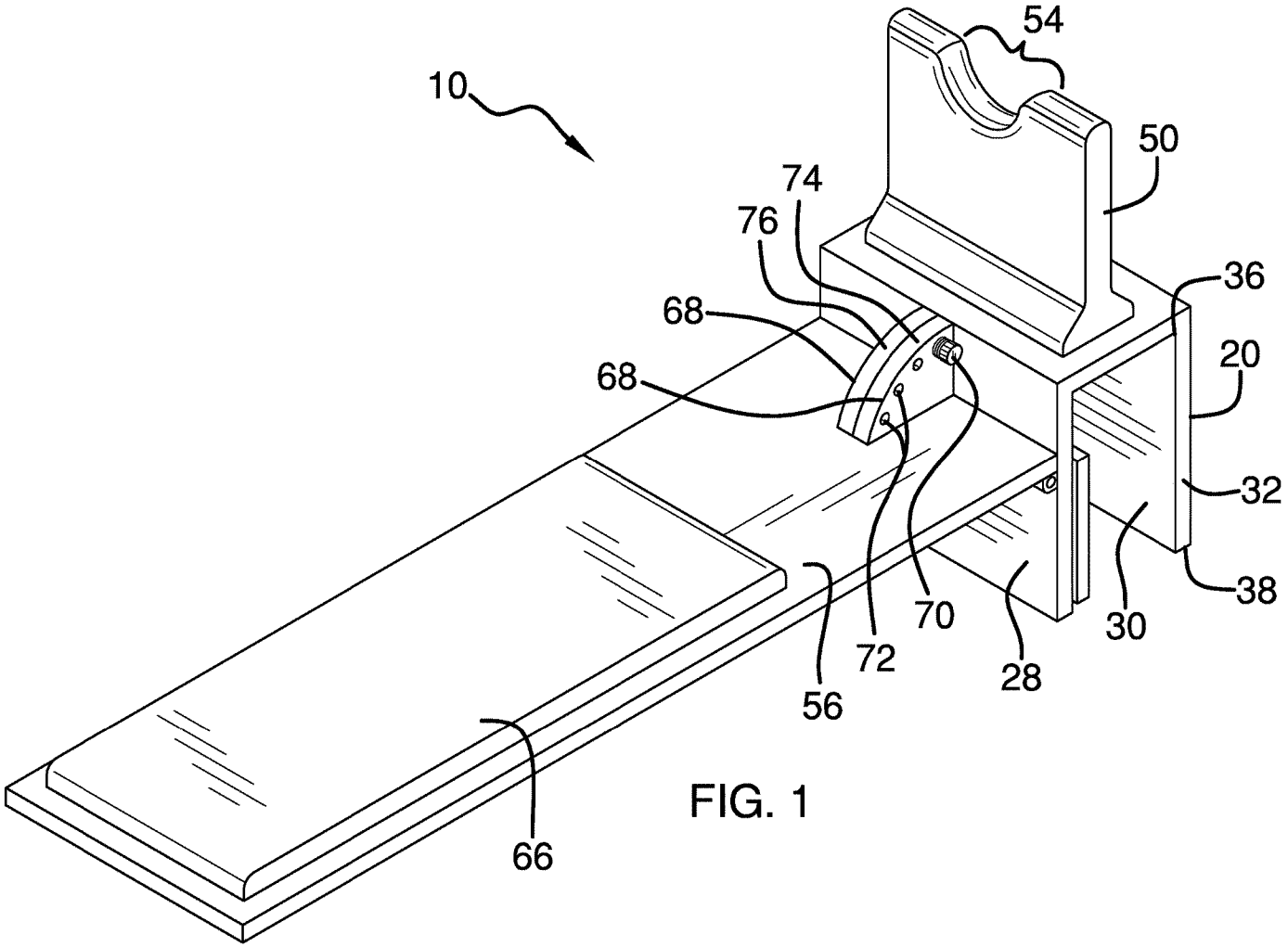
FIG. 1 is a front isometric view.
Figure 2:
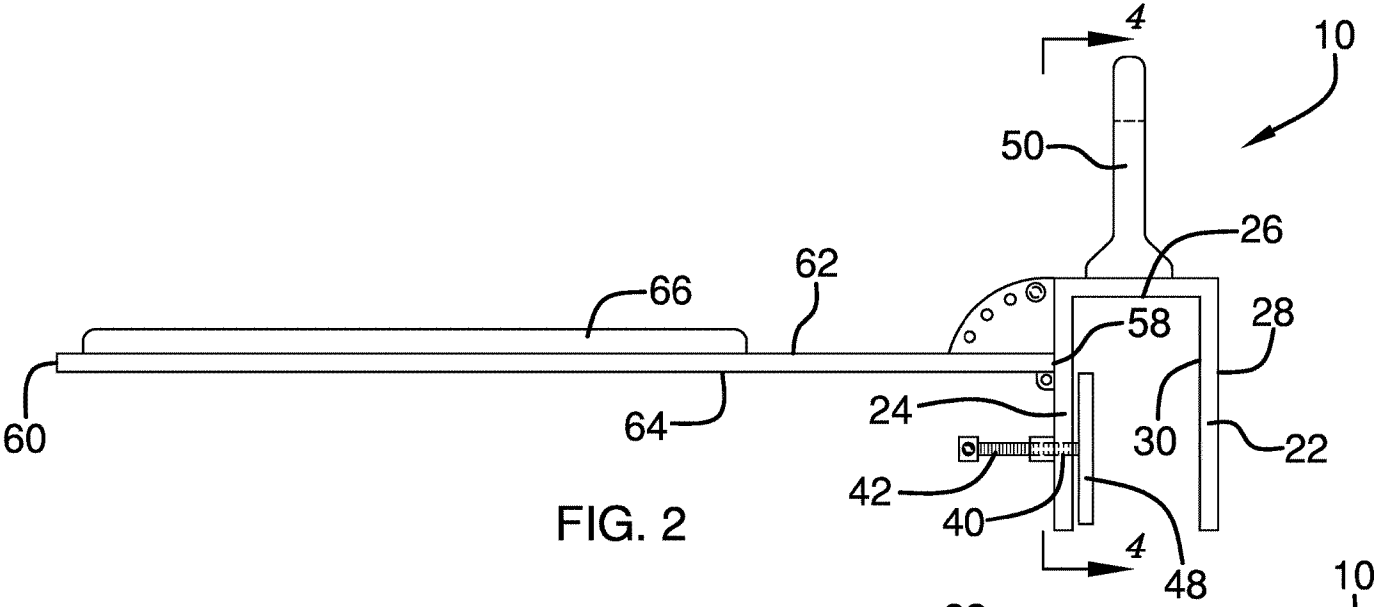
FIG. 2 is a side elevation view.
Figure 3:
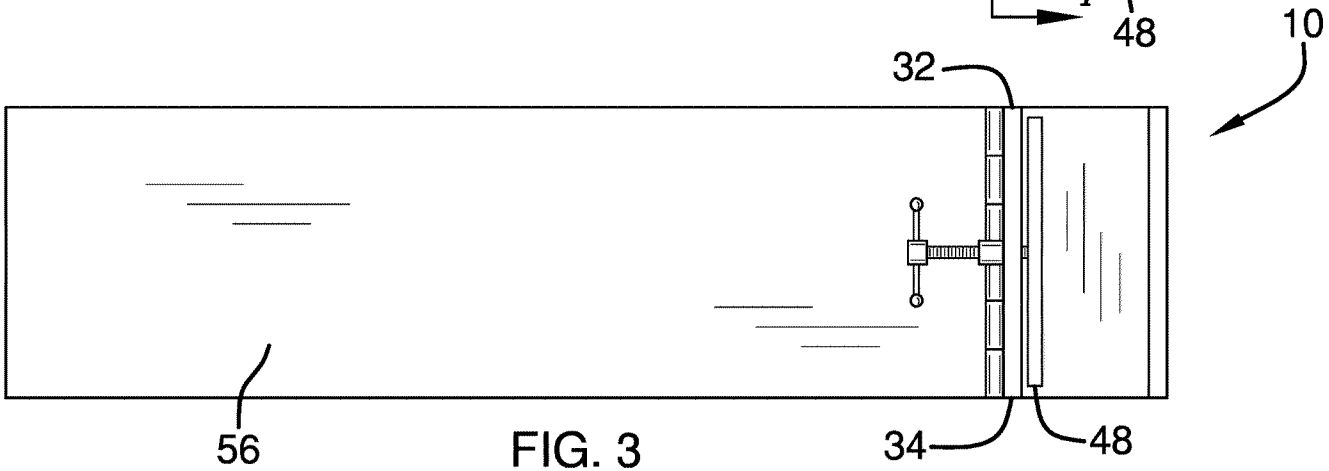
FIG. 3 is a bottom plan view.
Figure 4:
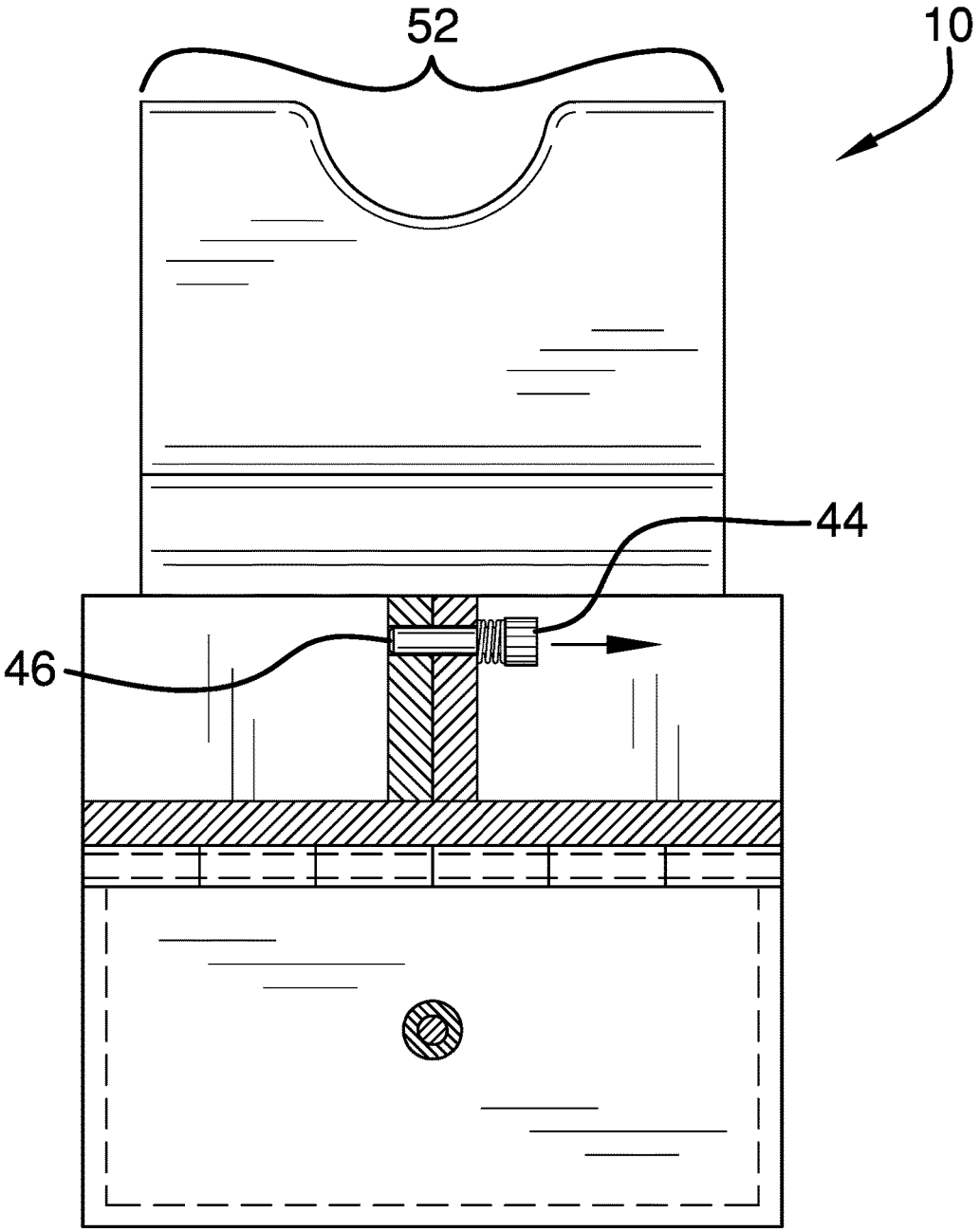
FIG. 4 is a cross-sectional view taken along line 4-4 of FIG. 2.
Figure 5:
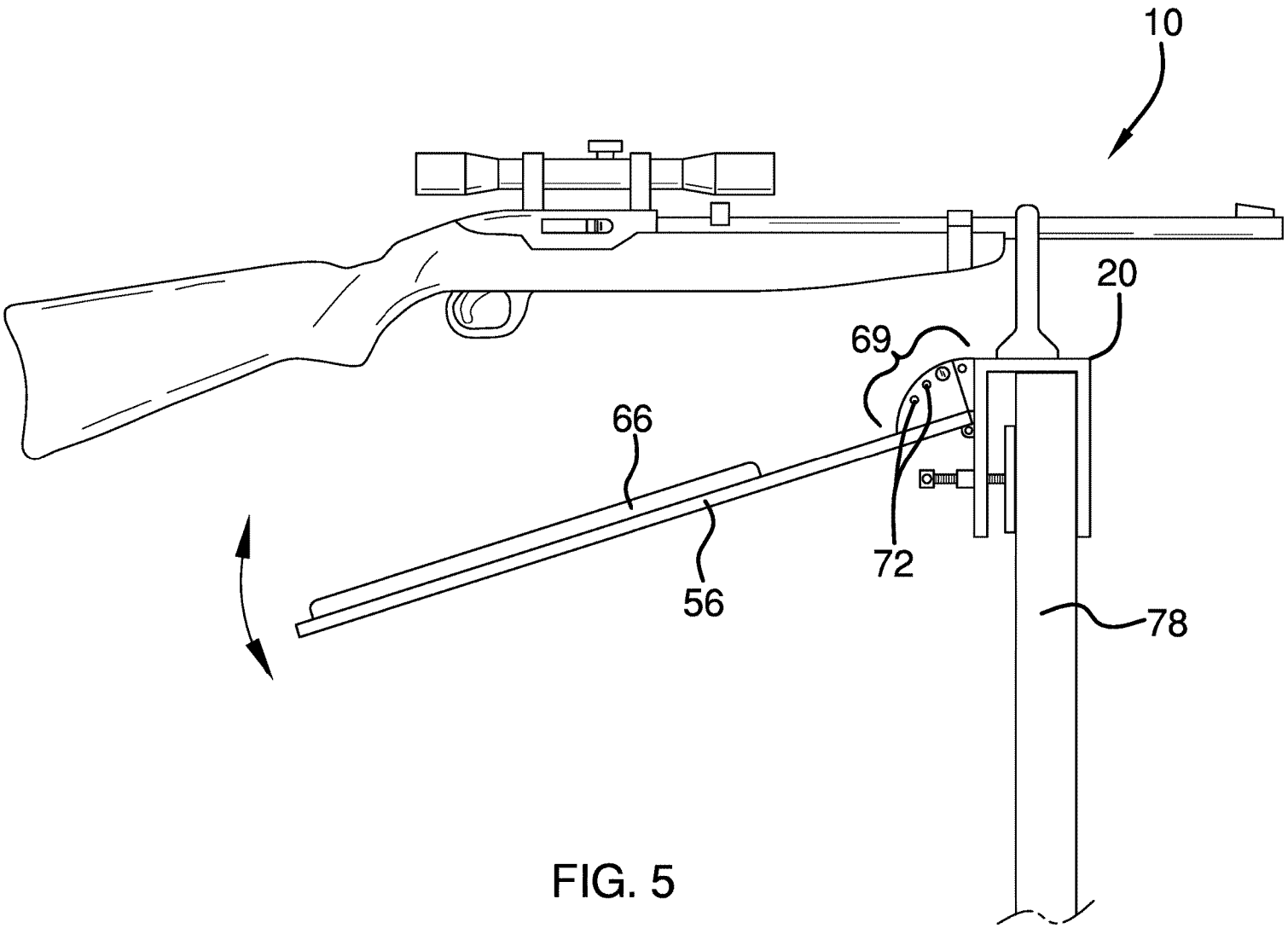
FIG. 5 is an in use view.

With reference now to the drawings, and in particular FIGS. 1 through 5 thereof, an example of the instant window mounted gun rest employing the principles and concepts of the present window mounted gun rest and generally designated by the reference number 10 will be described.

Referring to FIGS. 1 through 5 the present window mounted gun rest 10 is illustrated. The window mounted gun rest 10 includes a single inverted U-shaped mounting clamp 20 having a front portion 22, a rear portion 24, and a middle portion 26 disposed between the front portion 22 and the rear portion 24. Each of the front portion 22, the rear portion 24, and the middle portion 26 has an external surface 28 and an internal surface 30, and each of the front portion 22 and the rear portion 24 has a right surface 32, a left surface 34, a top surface 36, and a bottom surface 38. A threaded aperture 40 is disposed through the rear portion 24 of the mounting clamp 20 at approximately one-third of a height of the rear portion 24 from the bottom surface 38, with the threaded aperture 40 medially disposed between the right surface 32 and the left surface 34. A plate screw 42 is threadably engaged within the threaded aperture 40. The plate screw 42 has a head 44 disposed outside of the mounting clamp 20 and a tip 46 disposed between each of the front portion 22 and the rear portion 24 of the mounting clamp 20. A mounting plate 48 is disposed between each of the front portion 22 and the rear portion 24 of the mounting clamp 20. The mounting plate 48 is attached to the tip 46 of the plate screw 42.

The window mounted gun rest 10 further includes an upright substantially rectangular muzzle rest 50 medially disposed on the external surface 28 of the middle portion 26 of the mounting clamp 20. The muzzle rest 50 has an upper edge 52 and a U-shaped indentation 54 medially disposed on the upper edge 52. An elongated rectangular elevation support arm 56 is hingedly attached to the external surface 28 of the rear portion 24 of the mounting clamp 20 at approximately one-third of the height of the rear portion 24 from the top surface 36. The elevation support arm 56 has a front edge 58, a back edge 60, an upper surface 62, and a lower surface 64. A rectangular padded support member 66 is disposed on the upper surface 62 of the elevation support arm 56 from proximal the back edge 60 to approximately two-thirds of a length of the elevation support arm 56.

An elevation locking mechanism 69 further includes a pair of quadrant-shaped adjustment plates 68 and a spring-loaded locking pin 70. The pair of adjustment plates 68 is disposed on the upper surface 62 of the elevation support arm 56 adjacent to the front edge 58. Each of the pair of adjustment plates 68 has a plurality of circular openings 72. The spring-loaded locking pin 70 is removably and simultaneously disposable through one of the plurality of openings 72 of a first 74 of the pair of adjustment plates 68 and one of the plurality of openings 72 of a second 76 of the pair of adjustment plates 68. The elevation locking mechanism 69 is configured to selectively lock the elevation support arm 56 into one of a plurality of heights relative to the muzzle rest 50 depending on a preference of a user.

The mounting clamp 20 is removably disposable around a top area of a window sill of a deer blind 78. The plate screw 42 is configured to selectively secure the mounting plate 48 to the top area of the window sill of the deer blind 78. Each of the front portion 22, the rear portion 24, and the middle portion 26 of the mounting clamp 20 is optionally rectangular. Additionally, a width of the elevation support arm 56 is equal to a width of the rear portion 24 of the mounting clamp 20.

What is claimed is:

1. A window mounted gun rest comprising:

a single inverted U-shaped mounting clamp having a front portion, a rear portion, and a middle portion disposed between the front portion and the rear portion, each of the front portion, the rear portion, and the middle portion having an external surface and an internal surface, each of the front portion and the rear portion having a right surface, a left surface, a top surface, and a bottom surface;

a threaded aperture disposed through the rear portion of the mounting clamp at approximately one-third of a height of the rear portion from the bottom surface, the threaded aperture medially disposed between the right surface and the left surface;

a plate screw threadably engaged within the threaded aperture, the plate screw having a head disposed outside of the mounting clamp and a tip disposed between each of the front portion and the rear portion of the mounting clamp;

a mounting plate disposed between each of the front portion and the rear portion of the mounting clamp, the mounting plate attached to the tip of the plate screw;

an upright substantially rectangular muzzle rest medially disposed on the external surface of the middle portion of the mounting clamp, the muzzle rest having an upper edge and a U-shaped indentation medially disposed on the upper edge;

an elongated rectangular elevation support arm hingedly attached to the external surface of the rear portion of the mounting clamp at approximately one-third of the height of the rear portion from the top surface, the elevation support arm having a front edge, a back edge, an upper surface, and a lower surface;

a rectangular padded support member disposed on the upper surface of the elevation support arm from proximal the back edge to approximately two-thirds of a length of the elevation support arm; and an elevation locking mechanism further comprising:

a pair of quadrant-shaped adjustment plates disposed on the upper surface of the elevation support arm adjacent to the front edge, each of the pair of adjustment plates having a plurality of circular openings;

a spring-loaded locking pin removably and simultaneously disposable through one of the plurality of openings of a first of the pair of adjustment plates and one of the plurality of openings of a second of the pair of adjustment plates;

wherein the elevation locking mechanism is configured to selectively lock the elevation support arm into one of a plurality of heights relative to the muzzle rest depending on a preference of a user;

wherein the mounting clamp is removably disposable around a top area of a window sill of a deer blind;

wherein the plate screw is configured to selectively secure the mounting plate to the top area of the window sill of the deer blind.

2. The window mounted gun rest of claim 1 wherein each of the front portion, the rear portion, and the middle portion of the mounting clamp is rectangular.

3. The window mounted gun rest of claim 2 wherein a width of the elevation support arm is equal to a width of the rear portion of the mounting clamp.

* * * * *